US008726951B1

(12) United States Patent
Biondo et al.

(10) Patent No.: US 8,726,951 B1
(45) Date of Patent: May 20, 2014

(54) METHOD FOR COVERING HANDBAG WITH DESIGNER SCARF AND HANDBAG FOR PRACTICING METHOD

(76) Inventors: Rose A. Biondo, Clinton Township, MI (US); Richard C. Paschke, East China, MI (US)

( * ) Notice: Subject to any disclaimer, the term of this patent is extended or adjusted under 35 U.S.C. 154(b) by 191 days.

(21) Appl. No.: 13/176,178

(22) Filed: Jul. 5, 2011

Related U.S. Application Data

(63) Continuation-in-part of application No. 13/027,789, filed on Feb. 15, 2011, now abandoned.

(60) Provisional application No. 61/304,999, filed on Feb. 16, 2010.

(51) Int. Cl.
*A45C 3/08* (2006.01)
*A45C 13/02* (2006.01)

(52) U.S. Cl.
USPC ..... 150/105; 190/26; 383/111

(58) Field of Classification Search
USPC ..... 150/100, 102, 106, 107, 112; 190/24, 190/36, 107, 116, 26, 102; 383/111, 119
See application file for complete search history.

(56) References Cited

U.S. PATENT DOCUMENTS

| | | | | |
|---|---|---|---|---|
| 2,131,382 | A * | 9/1938 | Lobel | 150/105 |
| 2,779,373 | A * | 1/1957 | Koepke | 150/105 |
| 4,112,991 | A * | 9/1978 | Barbaresi | 150/104 |
| 4,185,673 | A * | 1/1980 | Daniello | 383/14 |
| 4,754,790 | A | 7/1988 | Meyers | 150/104 |
| 4,953,673 | A * | 9/1990 | Ambasz | 190/103 |
| 6,422,278 | B1 | 7/2002 | Grogan | 150/105 |
| 6,968,880 | B2 | 11/2005 | Battaglia et al. | 150/103 |
| 6,971,424 | B1 | 12/2005 | Angevine | 150/104 |
| 7,461,676 | B2 * | 12/2008 | Huie | 150/105 |
| 2006/0027292 | A1 | 2/2006 | Persic | 150/105 |
| 2007/0151820 | A1 * | 7/2007 | Lin et al. | 190/103 |
| 2007/0163689 | A1 * | 7/2007 | Pace et al. | 150/105 |
| 2007/0289681 | A1 * | 12/2007 | Bond | 150/104 |
| 2009/0151826 | A1 * | 6/2009 | Baxter | 150/104 |
| 2009/0188592 | A1 * | 7/2009 | Connacher et al. | 150/105 |
| 2010/0005633 | A1 * | 1/2010 | Nolet | 24/303 |
| 2010/0218862 | A1 * | 9/2010 | Ellermeyer | 150/104 |

* cited by examiner

*Primary Examiner* — Sue A Weaver
(74) *Attorney, Agent, or Firm* — Christopher P. Maiorana, PC

(57) ABSTRACT

A handbag including an outer bag and an inner bag. The inner bag and the outer bag are configured to entrap a piece of material wrapped around an exterior surface of the outer bag and tucked in between the outer bag and the inner bag.

20 Claims, 10 Drawing Sheets

Top View

Profile/Side View

Top View

METHOD FOR COVERING HANDBAG WITH DESIGNER SCARF AND HANDBAG FOR PRACTICING METHOD

This application is a continuation-in-part of U.S. application Ser. No. 13/027,789, filed Feb. 15, 2011 (now abandoned), which claims the benefit of U.S. Provisional Application No. 61/304,999, filed Feb. 16, 2010, which are hereby incorporated by reference in their entirety.

FIELD OF THE INVENTION

The present invention relates to handbags and purses generally and, more particularly, to a method and/or apparatus for customizing a handbag with a designer scarf.

BACKGROUND OF THE INVENTION

Designer scarfs provide a way to uniquely accessorize an outfit. Another way in which an outfit can be accessorized is with a custom handbag or purse. Scarfs have been used as trim on purses, but not as a way in which to completely customize the purse. It would be desirable to have a method and/or apparatus for completely customizing a handbag or purse using a designer scarf.

SUMMARY OF THE INVENTION

The present invention concerns a handbag including an outer bag and an inner bag. The inner bag and the outer bag are configured to entrap a piece of material wrapped around an exterior surface of the outer bag and tucked in between the outer bag and the inner bag The objects, features and advantages of the present invention include providing a method and/or apparatus for covering a handbag with a designer scarf that may (i) allow the use of a scarf to completely customize a handbag or purse, (ii) minimize damage to the scarf, (iii) allow use of the scarf with no alteration to the scarf, (iv) allow easy removal of the scarf, (v) use a number of magnets arranged to hold the scarf in place while the scarf covers the exterior surface of the handbag or purse, (vi) provide an adjustable band framework (or skeleton) arranged to hold the designer scarf in place while the scarf covers the exterior surface of the handbag or purse, and/or (vii) provide an interior liner for further protection to the scarf from contents of the handbag or purse.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention generally provides a method and/or apparatus for covering a handbag or purse with, for example, a designer scarf, a piece of fabric, or a t-shirt. However, the method and/or apparatus disclosed herein may be used for covering a handbag or purse with any other piece of material or fabric. The material or fabric may include, but is not limited to, silk, nylon, rayon, cotton, chamois, leather, vinyl, polyester, etc. The method and/or apparatus in accordance with embodiments of the present invention generally allows the use of a piece of material (e.g., a designer scarf, fabric, t-shirt, etc.) to completely customize a handbag or purse (e.g., covering the entire exterior of the handbag or purse), while minimizing damage to the material, allowing use of the scarf with no alteration to the scarf, and allowing easy removal of the scarf. In one example, when a t-shirt is used, the t-shirt may be cut up (e.g., to remove the sleeves and collar). The terms handbag and purse are used interchangeably and are not meant to be limitations, but rather to refer generally to any container for carrying small personal items (e.g., money, cosmetics, credit cards, identification, etc.) that may be carried by hand and/or with a strap.

Figure 1:
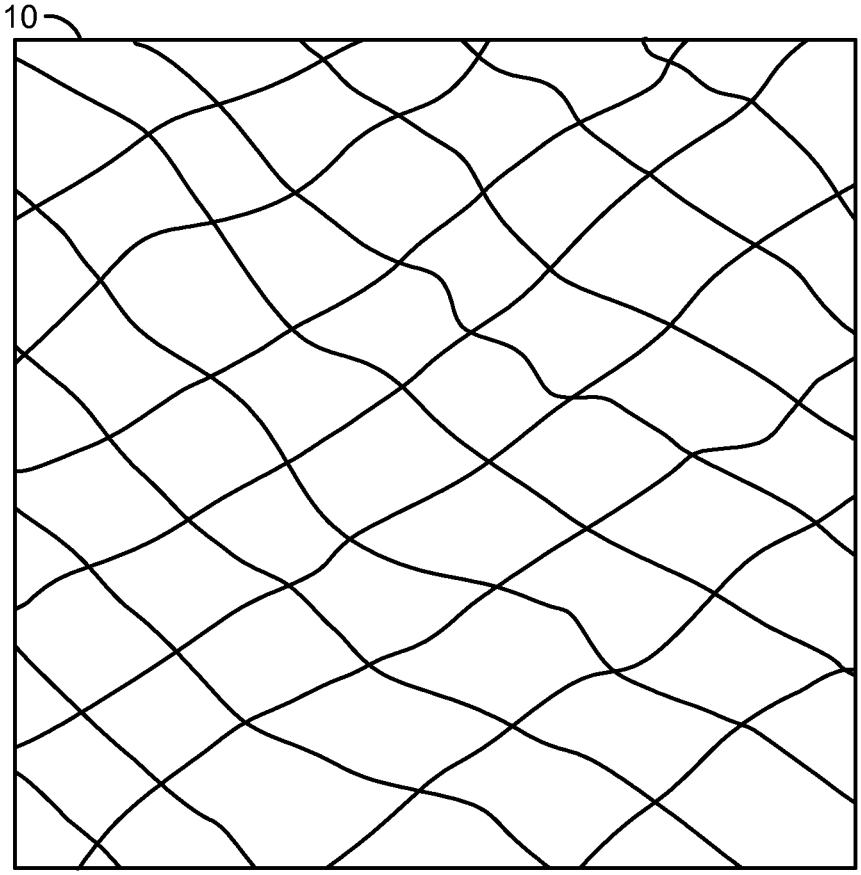
FIG. 1 is a diagram illustrating an example scarf that may be used in practicing the present invention.

Referring to FIG. 1, is a diagram is shown illustrating an example scarf 10 in accordance with example embodiments of the present invention. In one example, the scarf may comprise a designer scarf. The scarf 10 may be implemented, in one example, as a 35 inch (90 cm)×35 inch (90 cm) piece of designer patterned fabric. However, the scarf 10 may be implemented having other dimensions and/or fabrics and/or materials.

Figure 2:
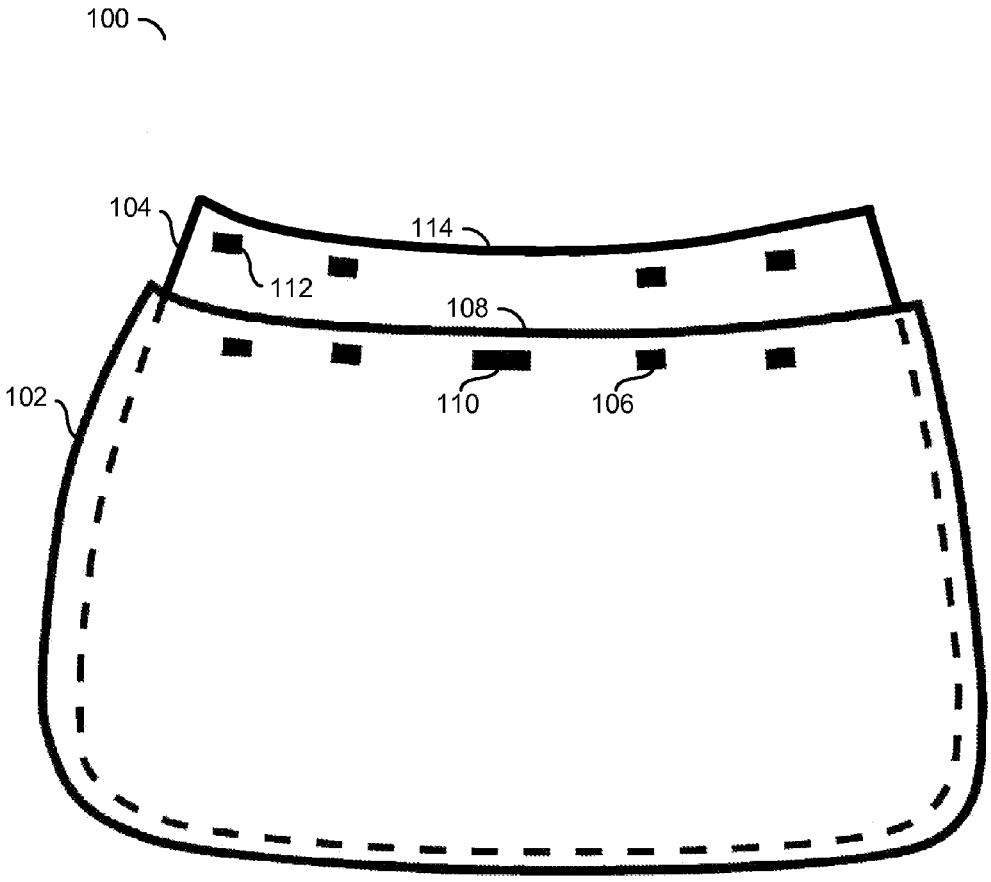
FIG. 2 is a diagram illustrating a handbag in accordance with an example embodiment of the present invention.

Referring to FIG. 2, a diagram is shown illustrating a handbag 100 implemented in accordance with an example embodiment of the present invention. In one example, the handbag 100 may comprise an outer bag 102 and an inner bag (or lining) 104. The outer bag 102 may include a number of first magnets 106 disposed around a periphery of a top opening 108 of the outer bag 102 and a number of magnets 110. The magnets 106 of the outer bag 102 may be arranged to hold the designer scarf 10 in place while the scarf 10 covers an exterior surface of the outer bag 102. The inner bag 104 may also include a number of magnets 112 disposed around a periphery of a top opening (or cuff) 114 of the inner bag 104. The magnets 112 of the inner bag 104 may be arranged to correspond with positions of the magnets 106 of the outer bag 102 in order to hold the scarf 10 in place while the scarf 10 covers the exterior surface of the outer bag 102. The magnets 106 and 112 may be rectangular, round, button shaped, etc. In one example, the magnets 106 and 112 may be implemented as rare earth magnets (e.g., neodymium, samarium-cobalt, etc.). The magnets 106 and 112 may be disposed in hems or pockets of the outer bag 102 and inner bag 104, respectively. In another example, the magnets may be glued or stitched into the respective bag. However, other methods of attaching the magnets to the respective bags may be implemented accordingly to meet the design criterial of a particular implementation.

In one example, the inner bag 104 may be placed within the outer bag 102 and attached (e.g., by glue, stitching, etc.) to the outer bag 102 at the bottom. The scarf 10 (or other material) may be applied around the outer bag 102 and tucked in a space formed between an inner surface of the outer bag 102 and an exterior surface of the inner bag 104. The cuff of the inner bag 104 may extend above the top opening of the outer bag 102, for example, to maintain a separation between the magnets 106 of the outer bag 102 and the magnets 112 of the inner bag 104 while the scarf 10 (or other material) is being applied (e.g., wrapped around the outer bag 102 and any excess tucked into the space between the inner surface of the outer bag 102 and the exterior surface of the inner bag 104. When the scarf 10 has been placed around the outer bag 102 and tucked in between the outer bag 102 and the inner bag 104, the cuff may be folded down to align the magnets 112 of the inner bag 104 with the magnets 106 of the outer bag 102, entrapping the scarf 10.

Figure 3:
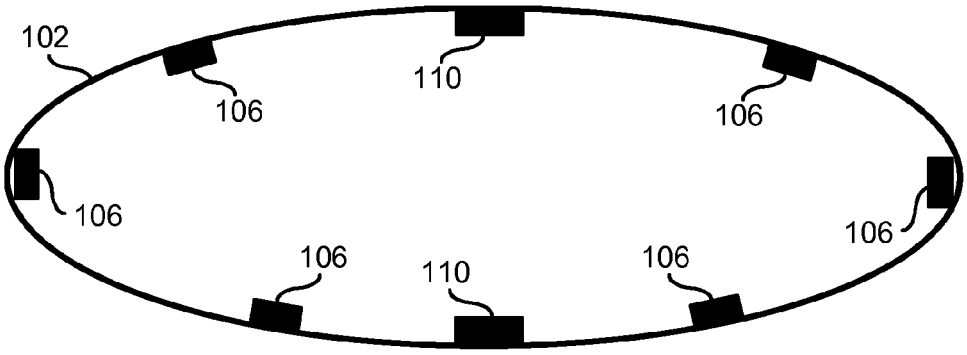
FIG. 3 is a diagram illustrating a top view of an outer bag of FIG. 1.

Referring to FIG. 3, a diagram is shown illustrating a top edge view of the outer bag 102 of FIG. 2. In one example, the top edge of the outer bag 102 may have a pair of magnets 110 that may be configured (e.g., like a clasp) to hold the in a closed position. The magnets 106 may be distributed around the top (or upper) edge of the outer bag 102 to provide an even clamping force when aligned with corresponding magnets 112 of the inner bag 104. The magnets 106 and 112 may be rectangular, round, button shaped, etc. In one example, the magnets 106 and 112 may be implemented as rare earth magnets (e.g., neodymium, samarium-cobalt, etc.). The magnets 106 and 112 may be disposed in hems or pockets of the outer bag 102 and inner bag 104, respectively. In another example, the magnets may be glued or stitched into the respective bag. However, other methods of attaching the magnets to the respective bags may be implemented accordingly to meet the design criterial of a particular implementation.

Figure 4:
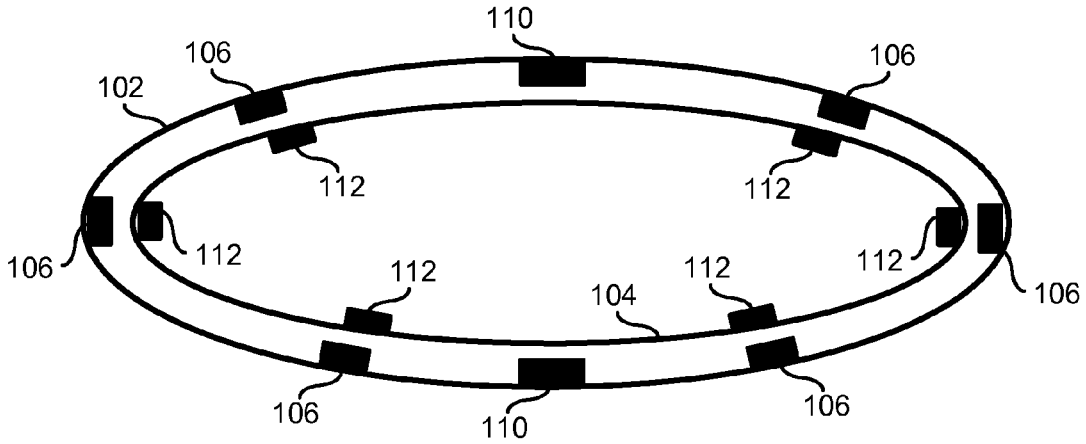
FIG. 4 is a diagram illustrating a top view of the outer bag and an inner lining of FIG. 1.

Referring to FIG. 4, a diagram is shown illustrating a top view of the inner lining 104 disposed within the outer bag 102 and illustrating alignment of the magnets 106 of the outer bag 102 with the magnets 112 of the inner bag 104. The magnets 106 and 112 are arranged on the outer bag 102 and inner bag 104, respectively, such that the magnets 106 and 112 attract one another when juxtaposed. In one example, the magnets may be brought into alignment by folding down the top edge or cuff 114 of the inner bag 102.

Figure 5:
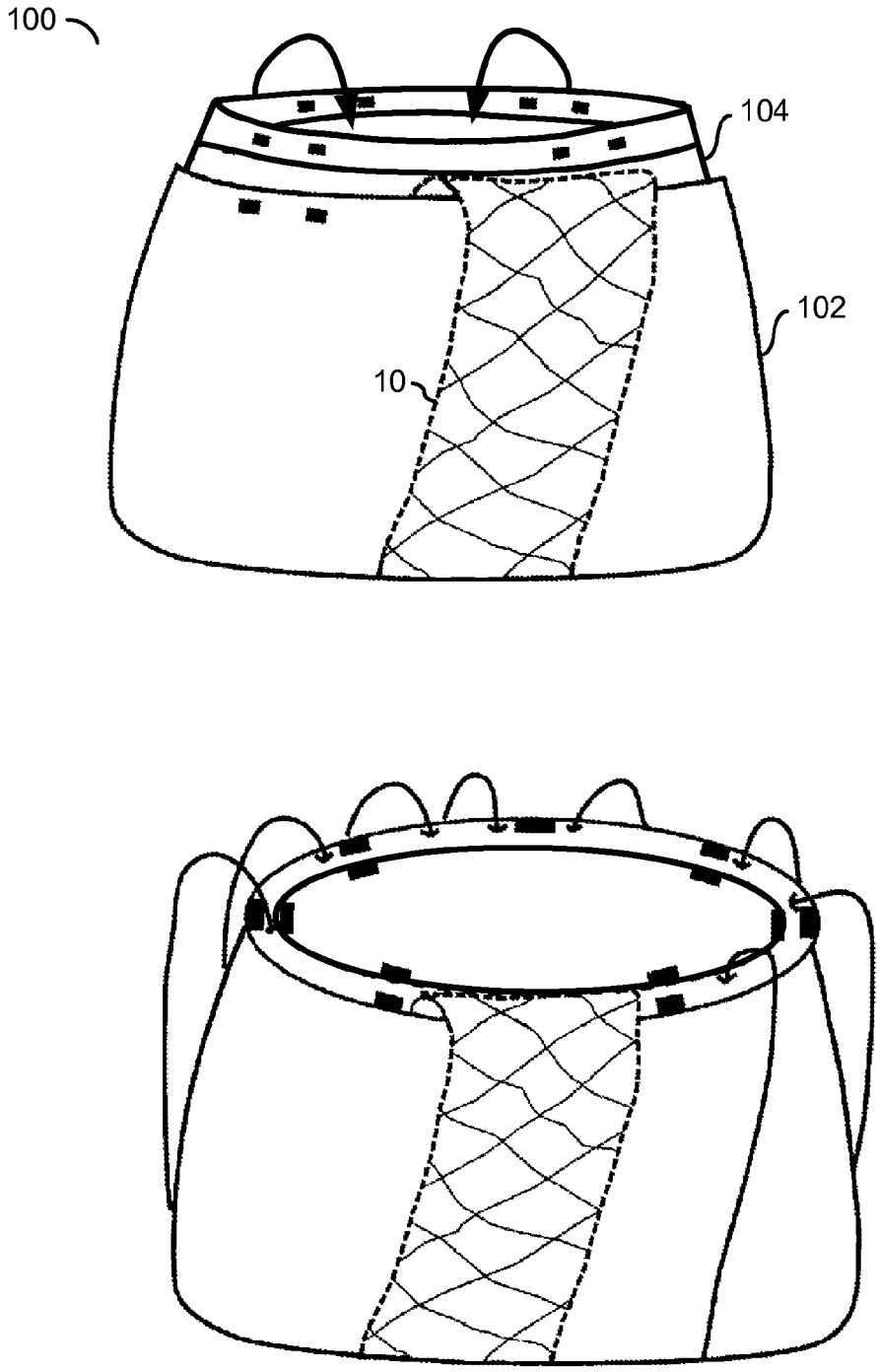
FIG. 5 is a diagram illustrating an example process of customizing a handbag in accordance with an embodiment of the present invention.

Referring to FIG. 5, a diagram is shown illustrating an example process of customizing the handbag 100 in accordance with an embodiment of the present invention. The scarf 10 (or other material) may be applied around the outer bag 102 and tucked in a space formed between an inner surface of the outer bag 102 and an exterior surface of the inner bag 104. The cuff of the inner bag 104 may extend above the top opening of the outer bag 102, for example, to maintain a separation between the magnets 106 of the outer bag 102 and the magnets 112 of the inner bag 104 while the scarf 10 (or other material) is being applied (e.g., wrapped around the outer bag 102 and any excess tucked into the space between the inner surface of the outer bag 102 and the exterior surface of the inner bag 104. When the scarf 10 has been placed around the outer bag 102 and tucked in between the outer bag 102 and the inner bag 104, the cuff may be folded down to align the magnets 112 of the inner bag 104 with the magnets 106 of the outer bag 102, entrapping the scarf 10 (indicated by the curved arrows).

Figure 6:
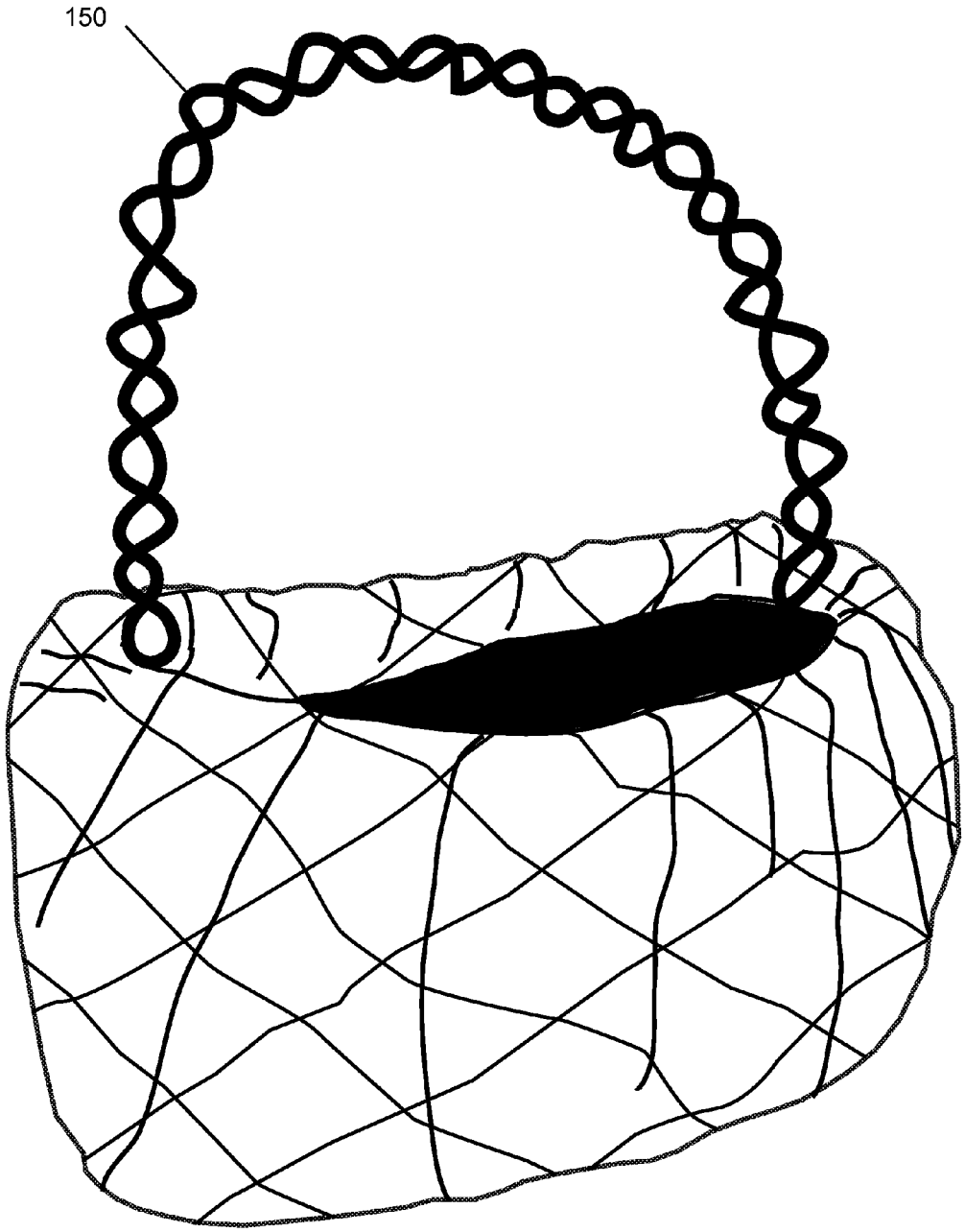
FIG. 6, is a diagram illustrating a handbag customized in accordance with an embodiment of the present invention.

Referring to FIG. 6, a diagram is shown illustrating a handbag customized in accordance with an embodiment of the present invention. When the scarf 10 or other material has be applied to the purse 100, the purse 100 may be further customized by adding a strap 150. The strap 150 may be attached to the inner liner 104 of the purse 100 using conventional techniques. Attaching the strap 150 to the inner liner 104 generally prevents damage to the scarf (or material) 10. In another example, the strap may be attached to the inner lining 104 in such a manner as to allow application and removal of the scarf 10 without removing the strap 150. The strap 150 may made from a variety of materials (e.g., leather, nylon, chain, cloth, cord, etc.). In one example, the strap 150 may be used to convert the purse 100 from a clutch style handbag to a shoulder style handbag.

Figure 7:
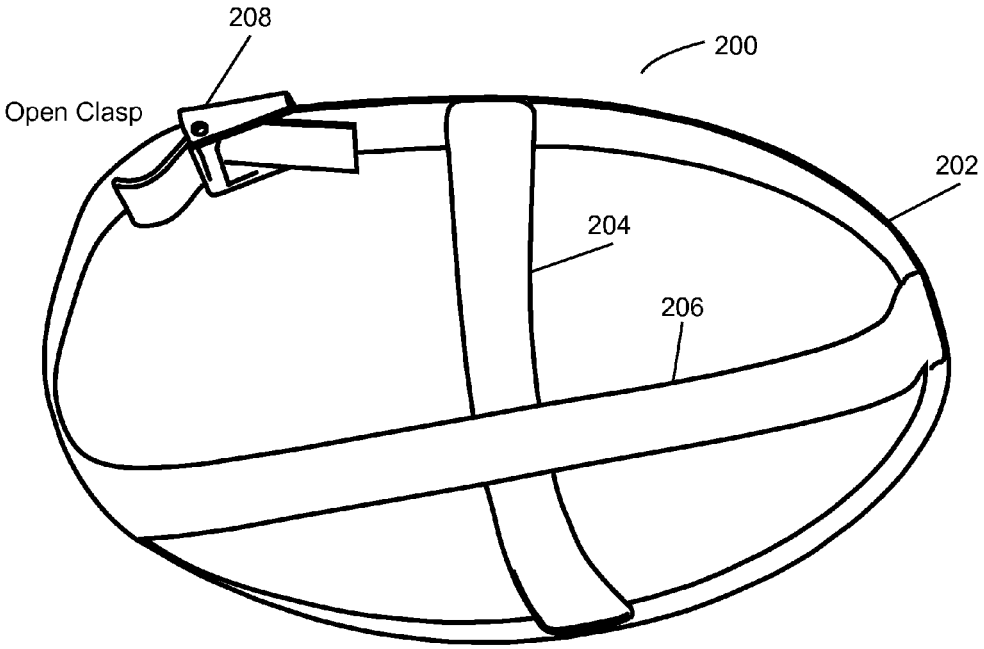
FIG. 7 is a diagram illustrating a top view of an expandable frame in accordance with another example embodiment of the present invention.

Referring to FIG. 7, a diagram is shown illustrating a top view of an adjustable frame in accordance with another example embodiment of the present invention. In one example, an adjustable band framework (or skeleton) 200 may be arranged to hold the designer scarf in place while the scarf covers the exterior surface of the handbag or purse, instead of using magnets. The frame work 200 may be implemented using a variety of materials (e.g., plastics, polymers, polystyrene, polyethylene, metals, alloys, leather straps that are reinforced for stiffness, etc.). In one example, the straps 202, 204 and 206 may be separate pieces that are attached to one another (e.g., by bonding, glueing, fusing, stitching, riveting, etc.). In another example, the framework 200 may comprise a one-piece construction (e.g., injection molded, etc.).

The framework 200 may be attached to an inner liner 104. The interior liner 104 generally provides further protection to the scarf from contents of the handbag or purse. In one example, the framework 200 may comprise a strap 202, a strap 204, a strap 206, and a clasp 208. The strap 202 is generally configured to match an upper opening of the purse into which the framework 200 is to be placed. The straps 204 and 206 may have different lengths and be attached to the strap 202 such that the straps 204 and 206 are aligned with a long axis and a short axis of the purse. In another example, the straps 204 and 206 may be of similar length and attached to the strap 202 in an X pattern. The straps 204 and 206 are generally configured to provide structural support to the strap 202.

The clasp 208 is generally configured to allow (i) the strap 202 to be shortened (or contracted) to allow application and removal of the scarf 10 from the purse and (ii) the strap 202 to be lengthened (or expanded) to entrap the scarf 10 once in place on the purse. In one example, the clasp 208 may be configured to allow the strap 202 to slide through in one position and lock the strap 202 from moving in a second position. In another example, the clasp 202 may attach to ends of the strap 202 and contract the strap 202 in a first position and expand the strap 202 in a second, position.

Figure 8:
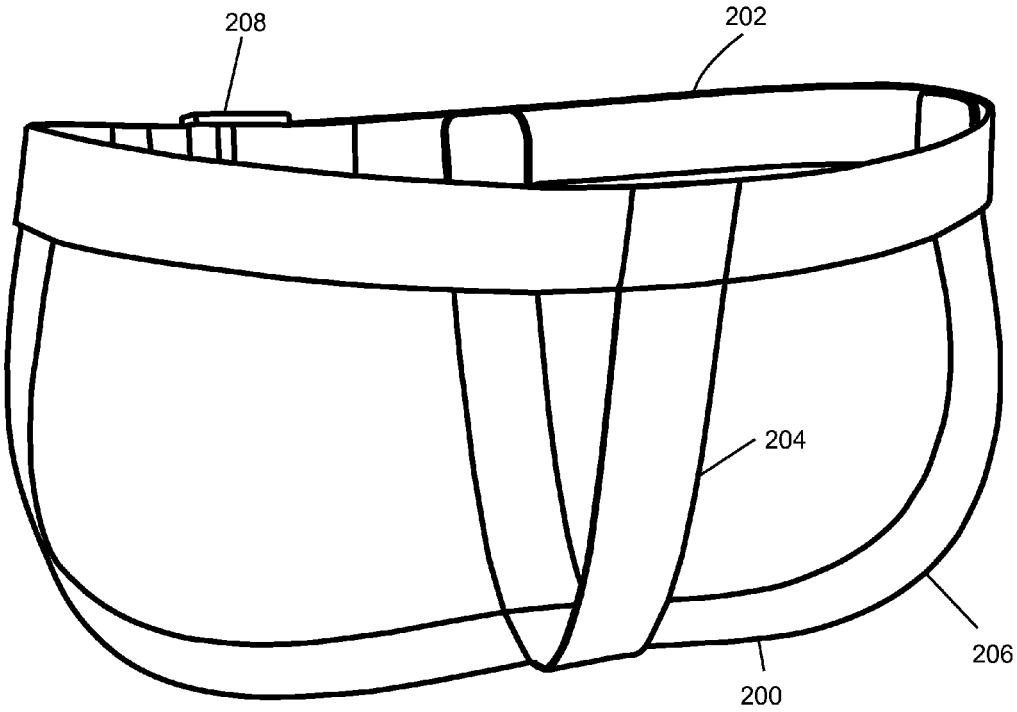
FIG. 8 is a diagram illustrating a side view of the expandable frame of FIG. 7.

Referring to FIG. 8, a diagram is shown illustrating a side view of the adjustable frame 200 of FIG. 7. The straps 204 and 206 may be configured to conform to (or define) an inner space of the purse 100. The framework 200 may be configured to provide support to objects being carried in the purse 100, for example, to provide further protection from damage (e.g., deformation, abrasion, etc.) to the scarf 10.

Figure 9:
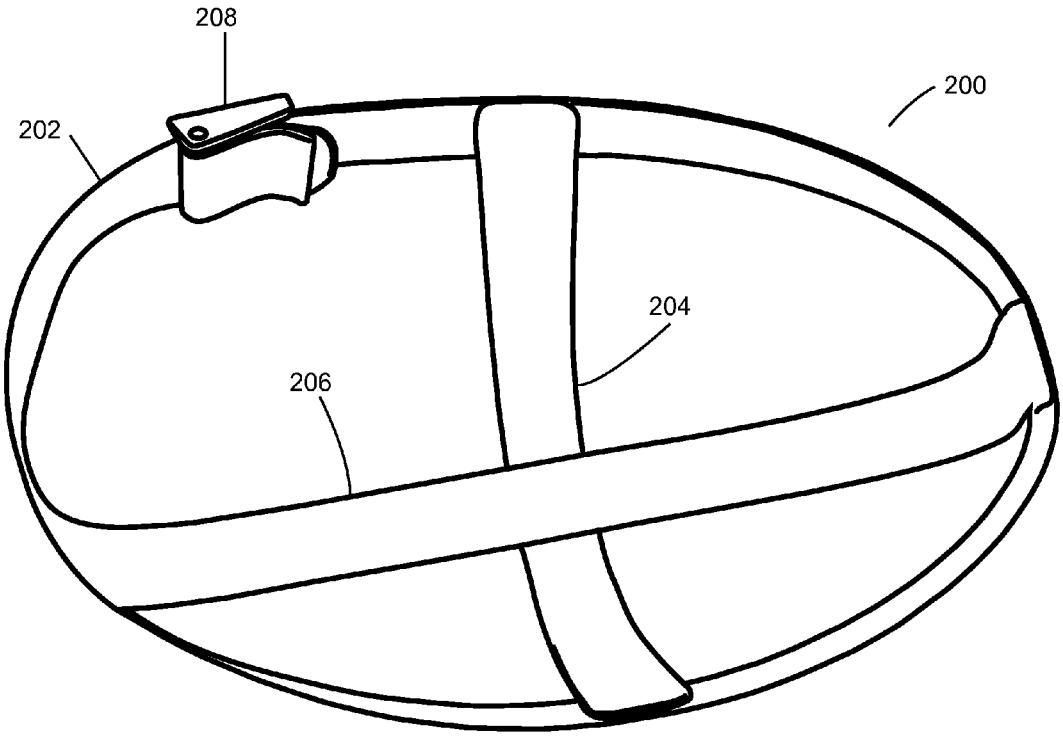
FIG. 9 is a diagram illustrating a locked position of the expandable frame of FIG. 7.

Referring to FIG. 9, a diagram is shown illustrating a locked position of the expandable frame 200 of FIG. 7. In one example, the clasp 208 may be configured to close into a locked position configured to hold the strap 202 such that pressure is applied to entrap the scarf 10 between the framework 200 and the outer bag 102 of the purse 100.

Figure 10:
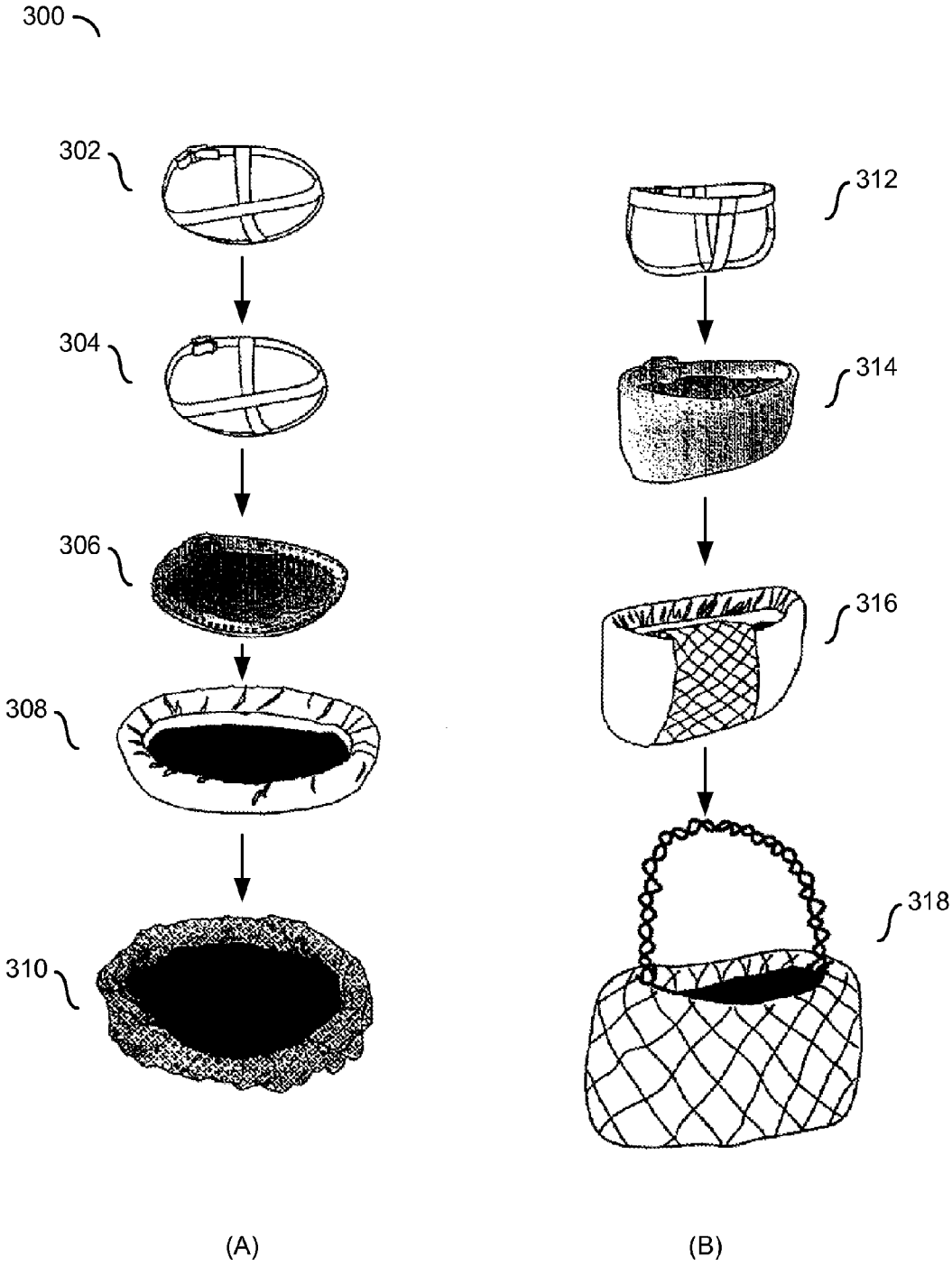
FIG. 10 is a diagram illustrating another example process of customizing a handbag in accordance with an embodiment of the present invention.

Referring to FIG. 10, a diagram is shown illustrating example steps of a process 300 for customizing a handbag in accordance with an embodiment of the present invention. In one example ((A) in FIG. 10), a number of steps 302-310 are shown illustrating the customization process (or method) 300 from a top view vantage point. In another example ((B) in FIG. 10), a number of steps 312-318 are shown illustrating the customization process (or method) 300 from a side (or lateral) view vantage point. In the step 302, the clasp of the framework 200 may be opened and the framework 200 contracted. In the step 304, the clasp 208 may be closed (or locked) to hold the framework 200 in the contracted state. In the step 306, the framework 200 may be place inside an inner liner (or bag). In the step 308, the scarf (or other material) 10 may be applied around an outer bag of the purse 100. In the step 310, the inner bag and framework may be placed inside the outer bag and the framework 200 expanded to entrap the scarf (or other material) 10 between the inner bag and framework and the outer bag.

Similarly, in the step 312, the framework 200 may be prepared for customizing a handbag implemented in accordance with an embodiment of the present invention. In the step 314, the framework 200 may be placed within an inner liner (or bag). In the step 316, the inner liner with the framework may be placed with an outer bag with the scarf (or other material) 10 already wrapped and tucked. In the step 318, the framework 200 may be adjusted to entrap the scarf or other material, and a strap 150 (described in connection with FIG. 5 above) may be attached.

A handbag in accordance with an embodiment of the present invention generally allows a person to turn a piece of fabric (e.g., a 35"/90 cm square silk scarf accessory, etc.) into the outer covering for a fashionable handbag/purse. In one example, the handbag may be placed in the center of the piece of fabric and the fabric may be drawn up and around the handbag and tucked between an inner liner and an outer bag. In one example, the inner liner may have a cuff that is banded with magnets. The cuff of the inner liner may be folded down (e.g., inward) to magnetically snap in place through an alignment of the magnets of the inner liner cuff with magnets of the outer bag. The alignment of the magnets generally serves to hold the fabric tightly in place. The handbag/purse may have loops for attaching a handle (or strap) if desired.

In another example, the cuff of the inner liner may be constructed with a band incorporating an adjustable locking device. The adjustable locking device may be configured to control a circumference of the band. The scarf may be tuck between the inner liner and the outer bag. The adjustable band may then be expanded to apply pressure on the scarf to hold the scarf in place. The locking device may be set to hold pressure on the scarf. When the scarf is to be removed, the locking device may be released, removing the pressure on the scarf and allowing easy removal.

While the invention is particularly shown and described with reference to preferred embodiments thereof, it will be understood by those skilled in the art that various changes in form and details may be made without departing from the spirit and scope of the invention.

The invention claimed is:

1. A handbag comprising:

an outer bag; and an inner bag, wherein (i) said inner bag is located within said outer bag, (ii) said inner bag is attached to said outer bag such that a bottom portion of an exterior bottom surface of said inner bag is permanently in contact with a bottom portion of an interior surface of said outer bag forming a pocket between said inner bag and said outer bag enabling a piece of fabric to be wrapped around an entire exterior surface of said outer bag and tucked into said pocket, and (iii) said inner bag comprises a cuff, wherein said cuff, when folded up, extends above an edge of an upper opening of said outer bag to enable said piece of fabric to be tucked into said pocket and, when folded down into an interior space of said inner bag, causes said piece of fabric to be entrapped within said pocket.

2. The handbag according to claim 1, wherein each of said cuff of said inner bag and said edge of said upper opening of said outer bag comprise a plurality of magnets configured to entrap said piece of fabric within said pocket when said magnets are brought into juxtaposition by said cuff being folded into said interior space of said inner bag.

3. The handbag according to claim 2, wherein said magnets comprise rare earth magnets.

4. The handbag according to claim 2, wherein said magnets comprise neodymium magnets.

5. The handbag according to claim 2, wherein said magnets comprise samarium-cobalt magnets.

6. The handbag according to claim 1, further comprising a removably attached strap.

7. The handbag according to claim 6, wherein said removably attached strap connects to said inner bag.

8. The handbag according to claim 1, wherein said inner bag is attached to said outer bag by at least one of glue and stitching.

9. The handbag according to claim 1, wherein said piece of fabric can be worn as a scarf when not covering said handbag.

10. A handbag comprising:

an outer bag;

an inner bag; and an adjustable frame, wherein said adjustable frame is configured to contract to fit within said inner bag and expand to entrap a piece of fabric wrapped around an entire outer surface of said outer bag and tucked in between an exterior surface of said inner bag and an interior surface of said outer bag, wherein said adjustable frame entraps said piece of fabric by pressing said inner bag and said piece of fabric against said interior surface of said outer bag.

11. The handbag according to claim 7, wherein said adjustable frame comprises:

a clasp;

a first strap attached to said clasp;

a second strap attached to said first strap and having a length corresponding to a long axis of said handbag; and a third strap attached to said first strap and said second strap, and having a length corresponding to a short axis of said handbag.

12. The handbag according to claim 11, wherein said first strap is adjustable when said clasp is in an unlocked position and fixed when said clasp is in a locked position.

13. The handbag according to claim 10, wherein said adjustable frame is formed as a single piece.

14. The handbag according to claim 13, wherein said adjustable frame comprises an injection molded plastic material.

15. A method of customizing a handbag comprising the steps of:

wrapping a piece of fabric around an entire external surface of an outer bag of said handbag and tucking a portion of said piece of fabric into a pocket formed between said outer bag and an inner bag of said handbag, wherein said pocket is formed by said inner bag being attached to said outer bag such that a bottom portion of an exterior bottom surface of said inner bag is permanently in contact with a bottom portion of an interior surface of said outer bag; and entrapping said piece of fabric in said pocket without damaging said piece of fabric by pressing said inner bag and said outer bag together.

16. The method according to claim 15, wherein said piece of fabric comprises at least one of a designer scarf and a part of a t-shirt.

17. The method according to claim 15, wherein the step of entrapping the piece of fabric comprises folding a cuff of said inner bag into an interior space of said inner bag and aligning pairs of magnets configured to clamp said piece of fabric between an exterior surface of said inner bag and an interior surface of said outer bag.

18. The method according to claim 17, wherein the step of aligning said pairs of magnets comprises folding said cuff of said inner bag containing a first set of magnets down into said interior space of said inner bag such that the first set of magnets is in juxtaposition with a second set of magnets disposed around a periphery of a top opening of said outer bag.

19. The method according to claim 15, wherein the step of entrapping the piece of fabric comprises expanding an adjustable framework disposed in said inner bag to press said inner bag and said piece of fabric against said interior surface of said outer bag.

20. The method according to claim 19, wherein the step of entrapping the piece of fabric further comprises locking said adjustable framework to maintain pressure on said inner bag and said piece of fabric.

* * * * *